US006244381B1

(12) United States Patent
Ruble

(10) Patent No.: US 6,244,381 B1
(45) Date of Patent: Jun. 12, 2001

(54) LADDER HOIST DEVICE

(76) Inventor: Timothy E. Ruble, Rte. 1 Box 316, Middlebourne, WV (US) 26149

( * ) Notice: Subject to any disclaimer, the term of this patent is extended or adjusted under 35 U.S.C. 154(b) by 0 days.

(21) Appl. No.: 09/506,563

(22) Filed: Feb. 18, 2000

(51) Int. Cl.[7] ..... E06C 7/16
(52) U.S. Cl. ..... 182/103
(58) Field of Search ..... 182/101–103, 182/36

(56) References Cited

U.S. PATENT DOCUMENTS

| | | | | |
|---|---|---|---|---|
| D. 260,754 | | 9/1981 | Gunnels . | |
| 2,394,148 | * | 2/1946 | Campbell | 182/103 |
| 2,588,959 | * | 3/1952 | Campbell | 182/103 |
| 2,714,434 | * | 8/1955 | Peterson | 182/103 |
| 3,115,211 | * | 12/1963 | Ostrander | 182/103 |
| 3,666,054 | * | 5/1972 | Ellings | 182/103 |
| 3,799,289 | | 3/1974 | Cecere, Jr. . | |
| 4,128,228 | | 12/1978 | Ziegelmann . | |
| 4,183,423 | | 1/1980 | Lewis . | |
| 5,239,758 | | 8/1993 | Lindell . | |
| 5,911,287 | * | 6/1999 | Campbell | 182/103 |

* cited by examiner

*Primary Examiner*—Alvin Chin-Shue

(57) ABSTRACT

A ladder hoist device for hoisting material up an extension ladder. The ladder hoist device includes a device that is able to move materials up and down an extension ladder. The device has a back plate. The back plate has a front side, a back side, a top edge and a bottom edge. A support plate supports the materials. The support plate has an edge fixedly coupled to the front side of the back plate. A mounting frame has a plurality of rollers for guiding the back plate along the rails of the ladder. A plurality of brackets rotatably couple the rollers to the back plate. Each of the brackets is coupled to each other and to the back plate. The rollers engage the ladder. A pulley system pulls the back plate up the ladder.

10 Claims, 5 Drawing Sheets

LADDER HOIST DEVICE

BACKGROUND OF THE INVENTION

1. Field of the Invention

The present invention relates to hoisting devices and more particularly pertains to a new ladder hoist device for hoisting material up an extension ladder.

2. Description of the Prior Art

The use of hoisting devices is known in the prior art. More specifically, hoisting devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,183,423; U.S. Pat. No. 2,714,434; U.S. Pat. No. 5,239,758; U.S. Pat. No. 4,128,228; U.S. Pat. No. 3,799,289; and U.S. Des. Pat. No. 260,754.

While these devices fulfill their respective, particular objectives and requirements, the aforementioned patents do not disclose a new ladder hoist device. The inventive device includes a device that is able to move materials up and down an extension ladder. The device has a back plate. The back plate has a front side, a back side, a top edge and a bottom edge. A support plate supports the materials. The support plate has an edge fixedly coupled to the front side of the back plate. A mounting frame has a plurality of rollers for guiding the back plate along the rails of the ladder. A plurality of brackets rotatably couple the rollers to the back plate. Each of the brackets is coupled to each other and to the back plate. The rollers engage the ladder. A pulley system pulls the back plate up the ladder.

In these respects, the ladder hoist device according to the present invention substantially departs from the conventional concepts and designs of the prior art, and in so doing provides an apparatus primarily developed for the purpose of hoisting material up an extension ladder.

SUMMARY OF THE INVENTION

In view of the foregoing disadvantages inherent in the known types of hoisting devices now present in the prior art, the present invention provides a new ladder hoist device construction wherein the same can be utilized for hoisting material up an extension ladder.

The general purpose of the present invention, which will be described subsequently in greater detail, is to provide a new ladder hoist device apparatus and method which has many of the advantages of the hoisting devices mentioned heretofore and many novel features that result in a new ladder hoist device which is not anticipated, rendered obvious, suggested, or even implied by any of the prior art hoisting devices, either alone or in any combination thereof.

To attain this, the present invention generally comprises a device that is able to move materials up and down an extension ladder. The device has a back plate. The back plate has a front side, a back side, a top edge and a bottom edge. A support plate supports the materials. The support plate has an edge fixedly coupled to the front side of the back plate. A mounting frame has a plurality of rollers for guiding the back plate along the rails of the ladder. A plurality of brackets rotatably couple the rollers to the back plate. Each of the brackets is coupled to each other and to the back plate. The rollers engage the ladder. A pulley system pulls the back plate up the ladder.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new ladder hoist device apparatus and method which has many of the advantages of the hoisting devices mentioned heretofore and many novel features that result in a new ladder hoist device which is not anticipated, rendered obvious, suggested, or even implied by any of the prior art hoisting devices, either alone or in any combination thereof.

It is another object of the present invention to provide a new ladder hoist device which may be easily and efficiently manufactured and marketed.

It is a further object of the present invention to provide a new ladder hoist device which is of a durable and reliable construction.

An even further object of the present invention is to provide a new ladder hoist device which is susceptible of a low cost of manufacture with regard to both materials and labor, and which accordingly is then susceptible of low prices of sale to the consuming public, thereby making such ladder hoist device economically available to the buying public.

Still yet another object of the present invention is to provide a new ladder hoist device which provides in the apparatuses and methods of the prior art some of the advantages thereof, while simultaneously overcoming some of the disadvantages normally associated therewith.

Still another object of the present invention is to provide a new ladder hoist device for hoisting material up an extension ladder.

Yet another object of the present invention is to provide a new ladder hoist device which includes a device that is able to move materials up and down an extension ladder. The device has a back plate. The back plate has a front side, a back side, a top edge and a bottom edge. A support plate supports the materials. The support plate has an edge fixedly coupled to the front side of the back plate. A mounting frame has a plurality of rollers for guiding the back plate along the rails of the ladder. A plurality of brackets rotatably couple the rollers to the back plate. Each of the brackets is coupled to each other and to the back plate. The rollers engage the ladder. A pulley system pulls the back plate up the ladder.

Still yet another object of the present invention is to provide a new ladder hoist device that is adjustable such that it may be used on different sized ladders.

Even still another object of the present invention is to provide a new ladder hoist device that has a pulley system which can be operated using power tools.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2:
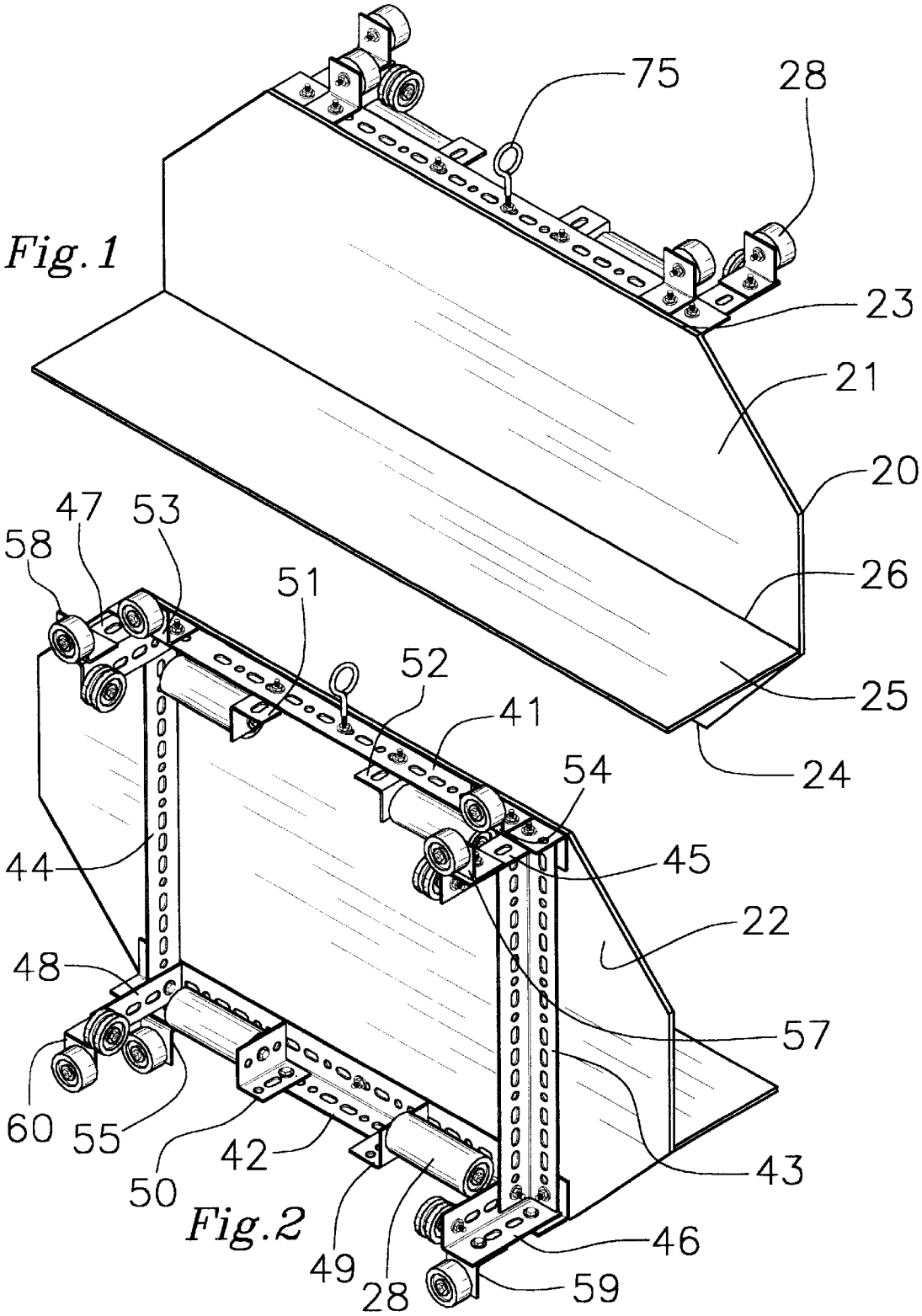
FIG. 1 is a schematic perspective front view of a new ladder hoist device according to the present invention.
FIG. 2 is a schematic perspective back view of the present invention.
Figure 3:
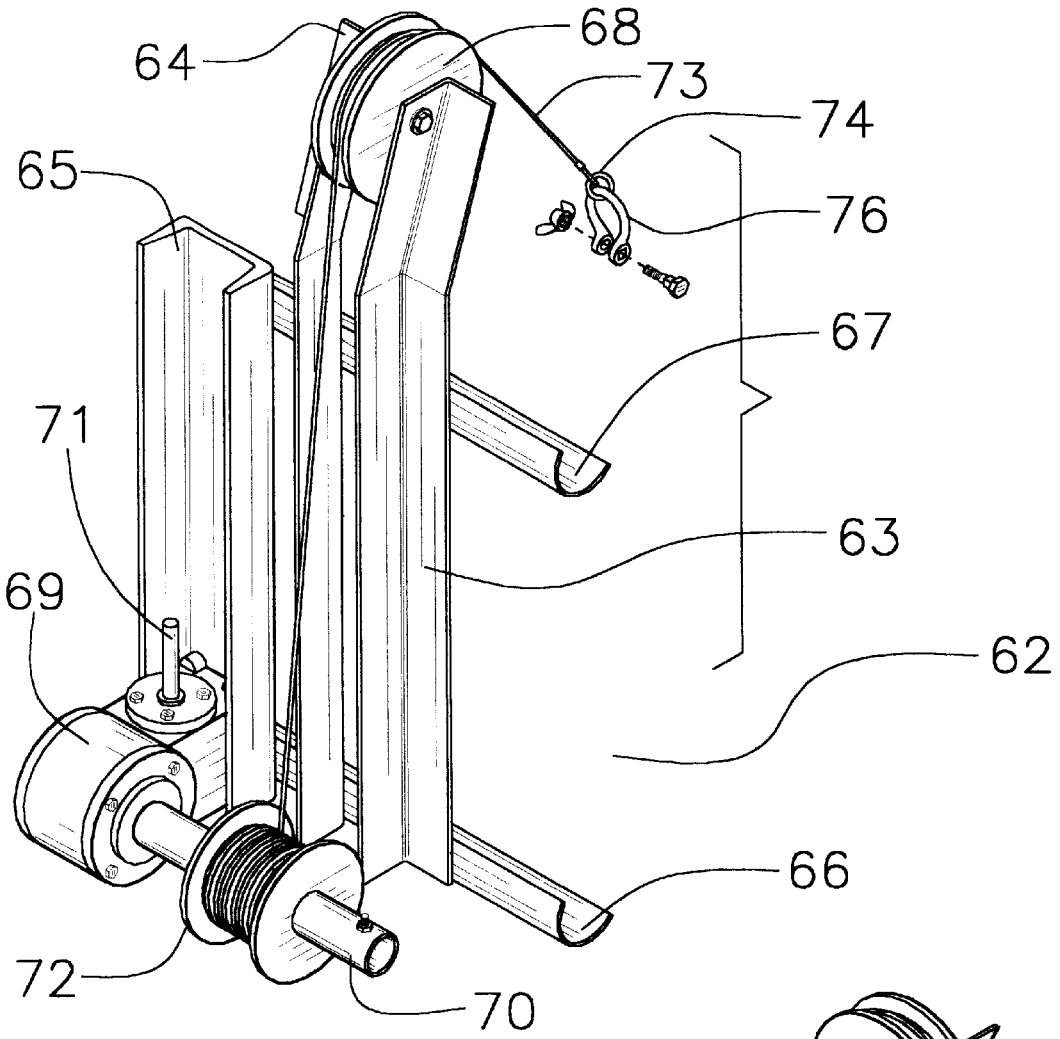
FIG. 3 is a schematic perspective view of the pulley system of the present invention.
Figure 4:
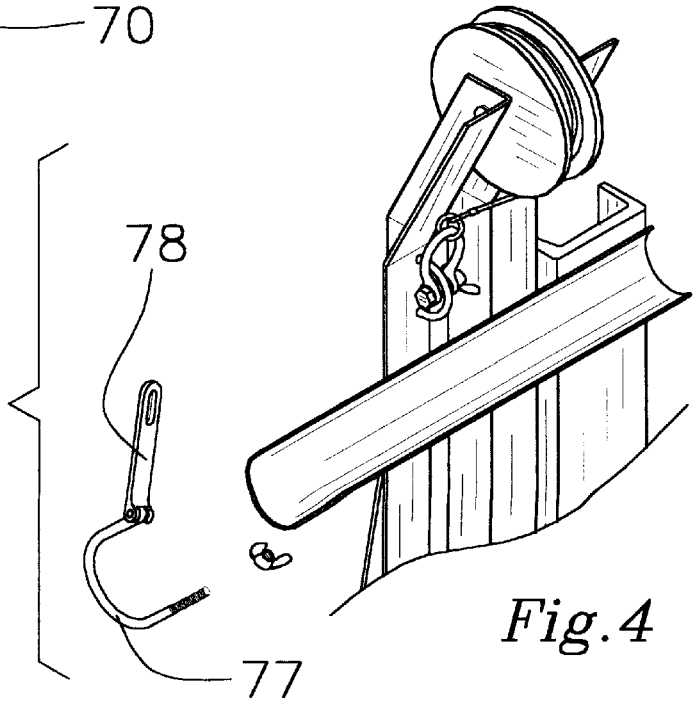
FIG. 4 is a schematic perspective view of the clamp for connecting the pulley means to the back plate of the present invention.
Figure 5:
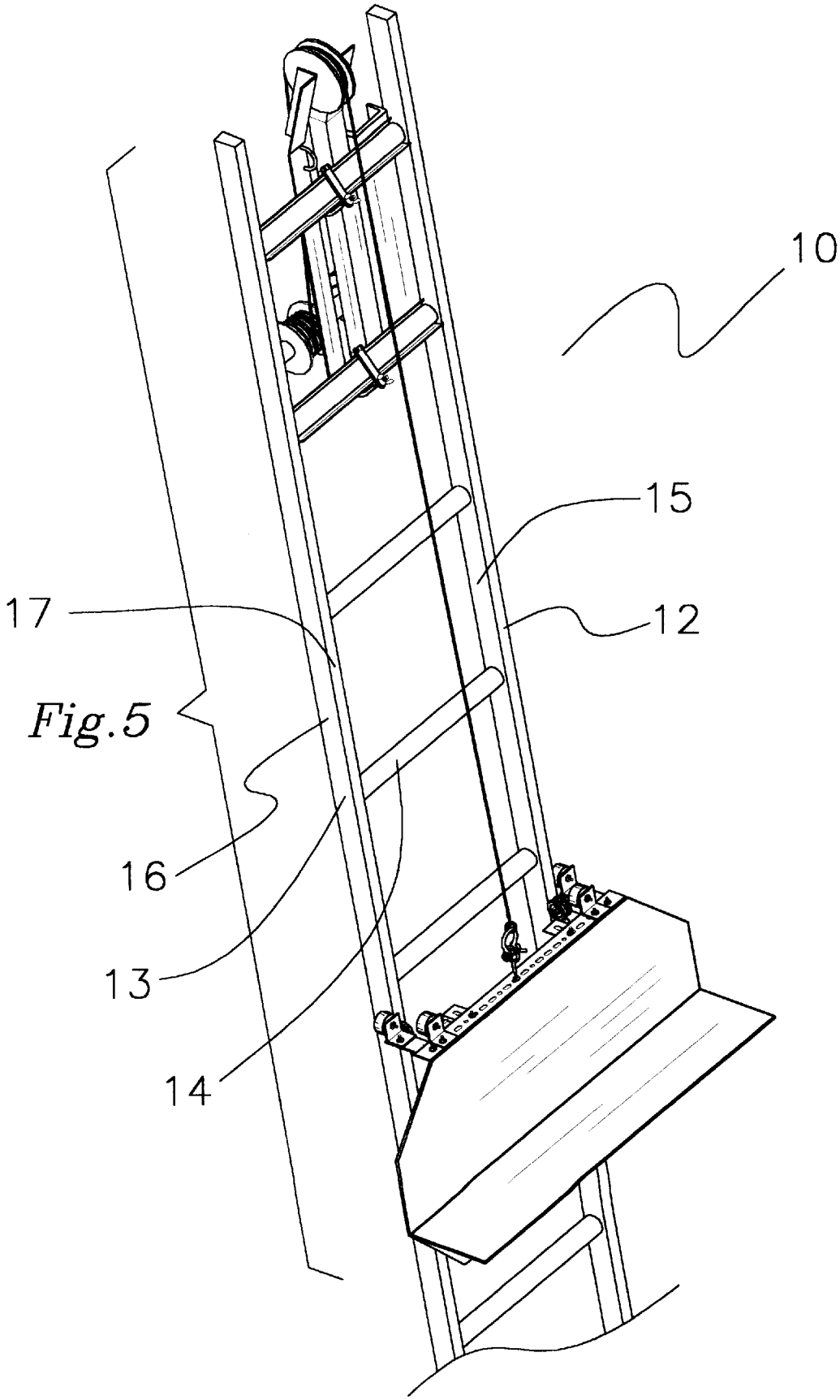
FIG. 5 is a schematic perspective view of the present invention on a ladder.
Figure 6:
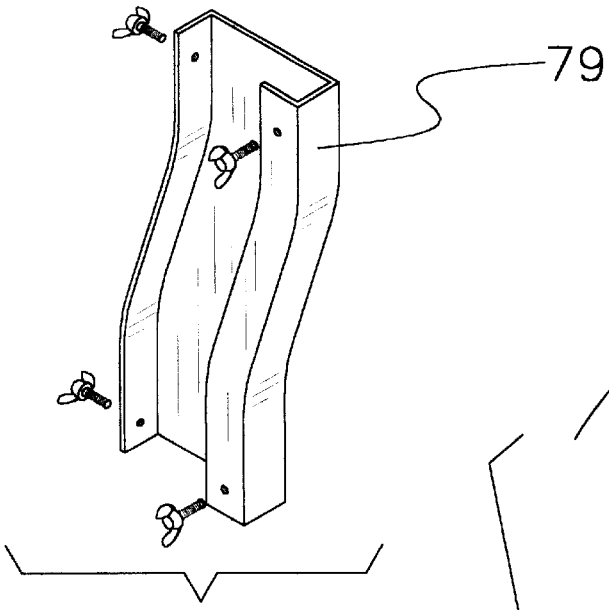
FIG. 6 is a schematic perspective view of a guide of the present invention.
Figure 7:
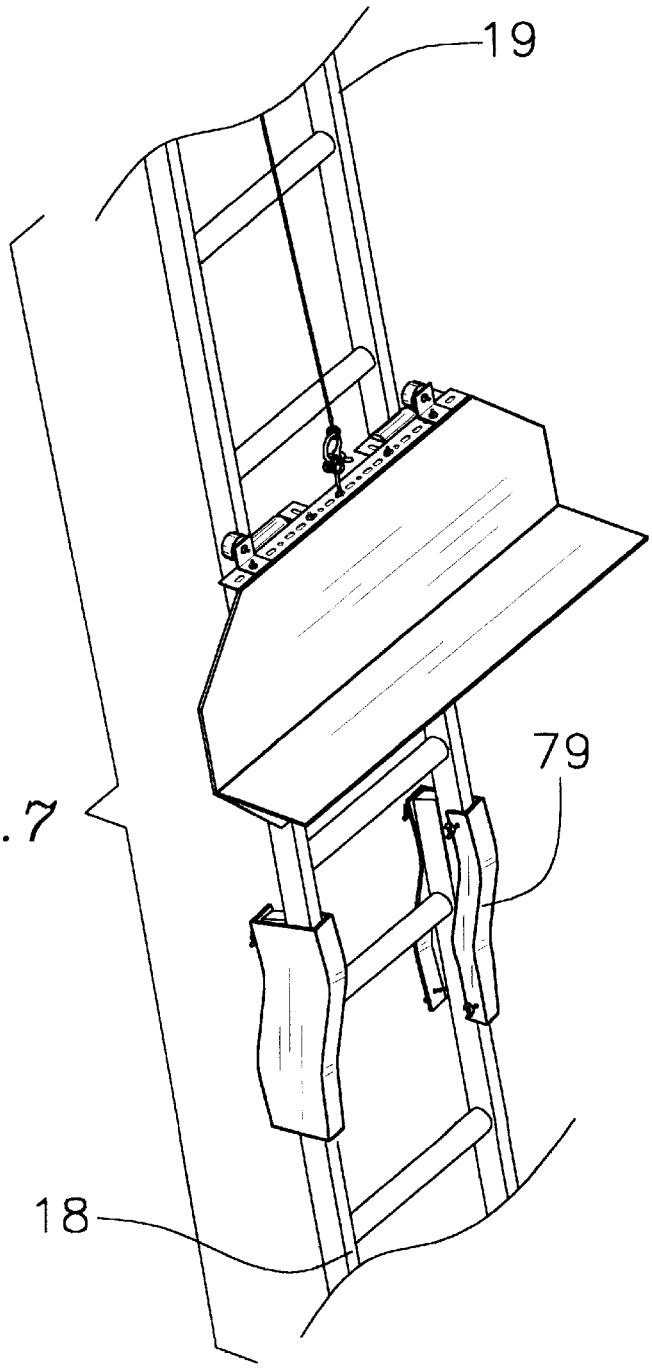
FIG. 7 is a schematic perspective view of the guides on the ladder.

With reference now to the drawings, and in particular to FIGS. 1 through 7 thereof, a new ladder hoist device embodying the principles and concepts of the present invention and generally designated by the reference numeral 10 will be described.

As best illustrated in FIGS. 1 through 7, the ladder hoist device 10 generally comprises a device for carrying material up an extension ladder 12. The ladder 12 has a pair of spaced side rails 13 and a plurality of rungs 14 extending between the rails 13. Each of the rails 13 has an inside wall 15, front wall 16 and outside wall 17. The ladder 12 is telescoping ladder having a first 18 and second 19 portion.

The device has a back plate 20 having a front side 21 and a back side 22. The back plate 20 has a top edge 23 and a bottom edge 24 and is preferably hexagonal shape.

A support plate 25 supports the materials. The support plate has an edge 26 fixedly coupled to the front side 21 of the back plate 20. The support plate 25 lies in a plane oriented generally perpendicular to a plane of the back plate 20 and parallel to the top edge 23 of the back plate 20. The support plate 25 is generally located closer to the bottom edge 24 than the top edge 23 of the back plate 20. The support plate 25 has a generally rectangular shape.

Figure 8:
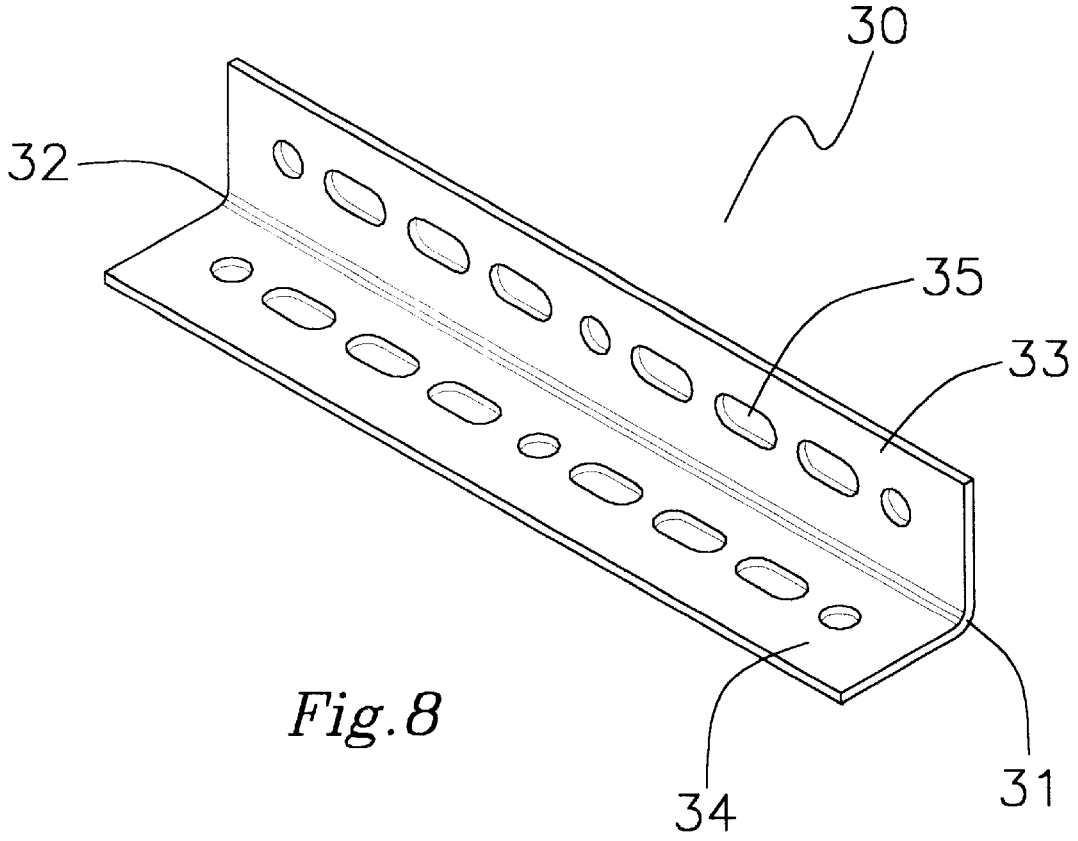
FIG. 8 is a schematic perspective view of a bracket of the ladder.

A mounting frame has a plurality of rollers 28 for guiding the back plate 20 along the rails 13 of the ladder 12 and plurality of brackets 30 for rotatably coupling the rollers 28 to the back plate 20. Each of the brackets 30 has a first end 31 and a second end 32. Each of the brackets 30 is elongate. The brackets have a generally L-shaped cross-section having a first portion 33 and a second portion 34 oriented generally perpendicular to each other. Each of the first 33 and second 34 portions is perforated 35. The first and second portions for each bracket will not be referred for ease of reading the Figures. The portions will only be shown in FIG. 8.

Each of the first portions 33 of a first 41 and second 42 bracket is removably coupled to the back side 22 of the back plate 20. The first 41 and second 42 brackets are oriented generally parallel to each other such that the first portions 33 of the first 41 and second 42 brackets extend towards each other. The first bracket 41 is generally located adjacent to the top edge 23 of the back plate 20. The second bracket 42 is located generally adjacent to the bottom edge 24 of the back plate 20. The first bracket 41 has a length generally equal to a length of the second bracket 42.

A third 43 and fourth 44 bracket extend between the first 41 and second 42 brackets. Each end 32, 31 of the first portions 33 of the third 43 and fourth 44 brackets is removably coupled to an end 32, 31 of the first 41 and second 42 brackets such that the first portions 33 of the third 43 and fourth 44 brackets extend away from each other. The third 43 and fourth 44 brackets are oriented generally parallel to each other. The third 43 and fourth 44 brackets each has a length generally equal to the distance between the first 41 and second 42 brackets.

Each of the first ends 31 of the second portions 34 of a fifth 45 and a sixth 46 bracket is removably secured to an end 31, 32 of the second portion 34 of the third bracket 43 such that the first portions 33 of the fifth 45 and sixth 46 brackets extend away from a middle portion of the back plate 20. The fifth 45 and sixth 46 brackets are at opposite ends of the third bracket. Each of a pair of rollers 28 is rotatably coupled to the second end 32 of the second portion 34 of the fifth 45 and sixth 46 brackets. Each of the rollers 28 is directed toward the middle portion of the back plate 20 and has a rotational axis oriented generally parallel to the back plate 20. The fifth 45 and sixth 46 brackets are oriented generally perpendicular to a plane of the back plate 20.

The first ends 31 of the second portions 34 of a seventh 47 and a eighth 48 bracket are removably secured to an end 31, 32 of the second portion 34 of the fourth bracket 44 such that the first portions 33 of the seventh 47 and eighth 48 brackets extend away from a middle portion of the back plate 20. Each of a pair of rollers 28 is rotatably coupled to the second end 32 of the second portion 34 of the seventh 47 and eighth 48 brackets. Each of the rollers 28 is directed toward the middle portion of the back plate 20 and has a rotational axis oriented generally parallel to the back plate. The seventh 47 and eighth 48 brackets are oriented generally perpendicular to a plane of the back plate 20.

A ninth 49 and tenth 50 bracket each has a first portion 33 removably secured to the second portion 34 of the second bracket 42 such that the ninth 49 and tenth 50 brackets extend away from the back side of the back plate 20. Each of a pair of rollers 28 each is rotatably coupled to the second portions 34 of the ninth 49 and tenth 50 brackets. One of the rollers 28 is between the ninth bracket 49 and the third bracket 43 and one of the rollers 28 is between the tenth bracket 50 and the fourth bracket 44. Each of the rollers 28 has a rotational axis oriented generally parallel to the back plate 20. The ninth 49 and tenth 50 brackets are located generally between the third 43 and fourth 44 brackets.

An eleventh 51 and twelfth 52 bracket each has a first portion 33 removably secured to the second portion 34 of the first bracket 41 such that the eleventh 51 and twelfth 52 brackets extend away from the back side of the back plate 20. Each of a pair of rollers 28 is rotatably coupled to the second portions 34 of the eleventh 51 and twelfth 52 brackets. One of the rollers 28 is between the twelfth bracket 52 and the third bracket 43 and one of the rollers 28 is between the eleventh bracket 51 and the fourth bracket 43. Each of the rollers 28 has a rotational axis oriented generally parallel to the back plate 20. The eleventh 51 and twelfth 52 brackets are located generally between the third 43 and fourth 44 brackets.

A thirteenth 53 and fourteenth 54 bracket each has a first portion 33 releasably secured to a second portion 34 of the first bracket 41 such that a second portion 34 of the thirteenth 53 and fourteenth 54 brackets extend away from the second bracket 42. Each of a pair of rollers 28 is rotatably coupled to the second portion 34 of the thirteenth 53 and fourteenth 54 brackets. Each of the rollers 28 is directed away from the support plate 25. Each of the rollers 28 has a rotational axis oriented generally perpendicular to the back plate 20. The thirteenth bracket 53 is generally located adjacent to the fourth bracket 44. The fourteenth bracket 54 is generally adjacent to the third bracket 43.

A fifteenth 55 and sixteenth (not shown) bracket each has a first portion 33 releasably secured to a second portion 34 of the second bracket 43 such that a second portion 34 of the fifteenth 55 and sixteenth brackets extends away from the first bracket 41. Each of a pair of rollers 28 for engaging the ladder 12 is rotatably coupled to the second portion 34 of the fifteenth 55 and sixteenth brackets. Each of the rollers 28 is directed away from the support plate 25. Each of the rollers 28 has a rotational axis oriented generally perpendicular to the back plate 20. The fifteenth bracket 55 is generally located adjacent to the fourth bracket 44. The sixteenth bracket is generally adjacent to the third bracket 43. Each of the rollers 28 engages one of the outside walls 16 of the rails 13.

A seventeenth 57 bracket has a first portion 33 coupled to the second end 32 of the fifth bracket 43 such that the second portion 34 of the seventeenth bracket 57 extends away from the support plate 25. A roller 28 is rotatably coupled to the second portion 34 of the seventeenth bracket 57. The roller 28 is directed away from the plate 25 and has a rotational axis oriented generally perpendicular to the back plate 20.

An eighteenth bracket 58 has a first portion 33 coupled to the second end 32 of the seventh bracket 47 such that the second portion 34 of the eighteenth bracket 58 extends away from the support plate 25. A roller 28 is rotatably coupled to the second portion 34 of the eighteenth bracket 58. The roller 28 is directed away from the support plate 25 and has a rotational axis oriented generally perpendicular to the back plate 20.

A nineteenth bracket 59 has a first portion 33 coupled to the second end 32 of the sixth bracket 46 such that the second portion 34 of the nineteenth bracket 59 extends away from the support plate 25. A roller 28 is rotatably coupled to the second portion 34 of the nineteenth bracket 59. The roller 28 is directed away from the support plate 25. The roller 28 has a rotational axis oriented generally perpendicular to the back plate 20.

A twentieth bracket 60 has a first portion 33 coupled to the second end 32 of the eighth bracket 48 such that the second portion 34 of the twentieth bracket 60 extends away from the support plate 25. A roller 28 is rotatably coupled to the second portion 34 of the twentieth bracket 60. The roller 28 is directed away from the plate 25. The roller 28 has a rotational axis oriented generally perpendicular to the back plate 20.

A pulley system 62 pulls the back plate 20 up the ladder 12. The pulley system 62 comprises three spaced vertical bars 63, 64, 65 and two spaced horizontal bars 66, 67 fixedly coupled to the vertical bars. Each of the horizontal bars 66, 67 is hemicylindrical. Each of the horizontal bars 66, 67 is adapted to rest against a rung 14 of the ladder 12. The horizontal bars have an interior directed upward so that they are biased against the rungs 14 when the pulley system is actuated.

A first pulley wheel 68 is rotatably mounted to and between a first 64 and a second 65 of the vertical bars.

A gear box 69 adapted to rotate a shaft 70 is fixedly mounted to the third vertical bar 65. The gear box 69 has the shaft 70 extending therefrom. The gear box 69 has a second shaft 71 which may be coupled to a power tool such as a drill to actuate the pulley system.

A second pulley wheel 72 is mounted on the first shaft 70.

A cord 73 is wrapped about the second pulley 72 and extends over the first pulley 68. The cord 73 has an end 74 adapted for coupling to the first bracket 41. A screw 75 having an annular member extending therefrom may be used to couple to hook 76 on the end 74 of the cord 73.

A pair of securing means 77 secures the horizontal bars to the rungs 14 of the ladder 12. Each of the securing means 77 is a hook having a bar 78 hingedly mounted thereto. Each of the bars 78 has a slot therein. An end of each of the hooks is threaded. Wherein each of the ends of the hooks is placed through the slots such that a finger screw or fly nut may be releasably secured to the threads on the hooks.

Additionally, guides 79 may be used to smooth the transition from the first portion 18 of the ladder 12 to the second portion 19 of the ladder 12. The guides 79 may be removably placed over the juncture of the first 18 and second 19 portions of the ladder.

In use, the brackets 30 may be moved in relation to the first 41 and second 42 brackets such that the distance between the third 43 and fourth 44 brackets is generally equal to the distance between the rails 13 of the ladder such that the rollers are in contact with the rails when the device is placed upon the ladder 12. The pulley system 62 is coupled to the top of the ladder 12 and materials are placed on the support plate 25 so that they may be brought up the ladder via the pulley system 62.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A ladder hoist device, said device being able to move materials up and down an extension ladder, said device comprising:

a back plate, said back plate having a front side and a back side, said back plate having a top edge and a bottom edge;

a support plate for supporting the materials, said support plate having an edge fixedly coupled to said front side of said back plate;

a mounting frame comprising:

a plurality of rollers for guiding the back plate along a the rails of the ladder;

a plurality of brackets for rotatable coupling said rollers to said back plate, each of said brackets being coupled to each other and to said back plate, wherein said rollers engage said ladder; and each of said brackets having a first end and a second end, each of said brackets being elongate, each of said brackets having a generally L-shaped cross-section, each of said brackets having a first portion and a second portion oriented generally perpendicular to each other, each of said first and second portions being perforated;

said plurality of brackets further comprising:

a first and second bracket, each of said first portions of said first and second brackets being removably coupled to said back side of said back plate, said first and second brackets being oriented generally parallel to each other such that said first portions of said first and second brackets extend towards each other, said first bracket being generally located adjacent to said top edge of said back plate, said second bracket being located generally adjacent to said bottom edge of said back plate, said first bracket having a length generally equal to a length of said second bracket;

a third and fourth bracket extending between said first and second brackets, each end of said first portions of said third and fourth brackets being removably coupled to an end of said first and second brackets such that said first portions of said third and fourth brackets extend away from each other, said third and fourth brackets being oriented generally parallel to each other, said third and fourth brackets each having a length generally equal to the distance between said first and second brackets;

a fifth and sixth bracket, each of said first ends of said second portions of said fifth and sixth brackets being removably secured to an end of said second portion of said third bracket such that said first portions of said fifth and sixth brackets extend away from a middle portion of said back plate, each of a pair of rollers each being rotatable coupled to said second end of said second portion of said fifth and sixth brackets, each of said rollers being directed toward said middle portion of said back plate and having a rotational axis oriented generally parallel to said back plate, said fifth and sixth brackets being oriented generally perpendicular to a plane of said back plate;

a seventh and eighth bracket, each of said first ends of said second portions of said seventh and eighth brackets being removably secured to an end of said second portion of said fourth bracket such that said first portions of said seventh and eighth brackets extend away from a middle portion of said back plate, each of a pair of rollers each being rotatably coupled to said second end of said second portion of said seventh and eighth brackets, each of said rollers being directed toward said middle portion of said back plate and having a rotational axis oriented generally parallel to said back plate, said seventh and eighth brackets being oriented generally perpendicular to a plane of said back plate; and a ninth and tenth bracket, each of said ninth and tenth brackets having a first portion removably secured to said second portion of said second bracket such that said ninth and tenth brackets extend away from said back side of said plate, each of a pair of rollers each being rotatably coupled to said second portions of said ninth and tenth brackets, one of said rollers being between said ninth bracket and said third bracket and one of said rollers being between said tenth bracket and said fourth bracket, each of said rollers having a rotational axis oriented generally parallel to said back plate, said ninth and tenth brackets being located generally between said third and fourth brackets; and a pulley, system for pulling said back plate up said ladder.

2. The ladder hoist device as in claim 1, wherein said support plate comprises:

said support plate lying in a plane oriented generally perpendicular to a plane of said back plate and parallel to said top edge of said back plate, said support plate being generally located closer to said bottom edge than said top edge of said back plate, said support plate having a generally rectangular shape.

3. The ladder hoist device as in claim 2, wherein said back plate comprises:

said back plate having a generally hexagonal shape.

4. The ladder hoist device as in claim 1, wherein said plurality of brackets comprises:

an eleventh and twelfth bracket, each of said eleventh and twelfth brackets having a first portion removably secured to said second portion of said first bracket such that said eleventh and twelfth brackets extend away from said back side of said plate, each of a pair of rollers each being rotatably coupled to said second portions of said eleventh and twelfth brackets, one of said rollers being between said twelfth bracket and said third bracket and one of said rollers being between said eleventh bracket and said fourth bracket, each of said rollers having a rotational axis oriented generally parallel to said back plate, said eleventh and twelfth brackets being located generally between said third and fourth brackets.

5. The ladder hoist device as in claim 4, wherein said plurality of brackets comprises:

a thirteenth and fourteenth bracket, each of said thirteenth and fourteenth brackets having a first portion releasably secured to a second portion of said first bracket such that a second portion of said thirteenth and fourteenth brackets extend away from said second bracket, each of a pair of roller being rotatably coupled to said second portion of said thirteenth and fourteenth brackets, each of said rollers being directed away from said support plate, each of said rollers having a rotational axis oriented generally perpendicular to said back plate, said thirteenth bracket being generally located adjacent to said fourth bracket, said fourteenth bracket being generally adjacent to said third bracket.

6. The ladder hoist device as in claim 5, wherein said plurality of brackets comprises:

a fifteenth and sixteenth bracket, each of said fifteenth and sixteenth brackets having a first portion releasably secured to a second portion of said second bracket such that a second portion of said fifteenth and sixteenth brackets extends away from said first bracket, each of a pair of rollers for engaging said ladder being rotatably coupled to said second portion of said fifteenth and sixteenth brackets, each of said rollers being directed away from said support plate, each of said rollers having a rotational axis oriented generally perpendicular to said back plate said fifteenth bracket being generally located adjacent to said fourth bracket, said sixteenth bracket being generally adjacent to said third bracket.

7. The ladder hoist device as in claim 6, wherein said plurality of brackets comprises:

a seventeenth bracket, said seventeenth bracket having a first portion coupled to said second end of said fifth bracket such that said second portion of said seventeenth bracket extends away from said support plate, a roller being rotatably coupled to said second portion of said seventeenth bracket, said roller being directed away from said plate, said roller having a rotational axis oriented generally perpendicular to said back plate;

an eighteenth bracket, said eighteenth bracket having a first portion coupled to said second end of said seventh bracket such that said second portion of said eighteenth bracket extends away from said support plate, a roller being rotatably coupled to said second portion of said eighteenth bracket, said roller being directed away from said plate, said roller having a rotational axis oriented generally perpendicular to said back plate;

a nineteenth bracket, said nineteenth bracket having a first portion coupled to said second end of said sixth bracket such that said second portion of said nineteenth bracket extends away from said support plate, a roller being rotatably coupled to said second portion of said nineteenth bracket, said roller being directed away from said plate, said roller having a rotational axis oriented generally perpendicular to said back plate;

a twentieth bracket, said twentieth bracket having a first portion coupled to said second end of said eighth bracket such that said second portion of said twentieth bracket extends away from said support plate, a roller being rotatably coupled to said second portion of said twentieth bracket, said roller being directed away from said plate, said roller having a rotational axis oriented generally perpendicular to said back plate.

8. The ladder hoist device as in claim 1, wherein said pulley system comprises:

three spaced vertical bars:

two spaced horizontal bars fixedly coupling said vertical bars, each of said horizontal bars being hemicylindrical, each of said horizontal bars being adapted to rest against a rung of the ladder;

a first pulley wheel, said first pulley wheel being rotatably mounted to and between a first and a second of said vertical bars;

a gear box adapted to rotate a shaft, said gear box being fixedly mounted to a third vertical bar, said gear box having said shaft extending therefrom;

a second pulley wheel, said second pulley wheel being mounted on said shaft;

a cord, said cord being wrapped about said second pulley and extending over said first pulley, said cord having an end adapted for coupling to said first bracket, and a pair of securing means for securing said horizontal bars to the rungs of the ladder, each of said securing means being a hook having a bar hingedly mounted thereto, each of said bars having a slot therein, an end of each of said hooks being threaded, wherein each of the ends of said hooks is placed through said slots such that a finger screw may be releasably secured to the threads on said hooks.

9. A ladder hoist device for moving materials up and down an extension ladder, said device comprising:

a back plate having a front side and a back side, said back plate having a top edge and a bottom edge;

a support plate having an edge fixedly coupled to said front side of said back plate;

a mounting frame comprising:

a plurality of rollers for guiding the back plate along the rails of the ladder;

a plurality of brackets for rotatably coupling said rollers to said back plate each of said brackets being coupled to each other and to said back plate, wherein said rollers engage said ladder; and each of said brackets having a first end and a second end, each of said brackets having a first portion and a second portion;

said plurality of brackets further comprising:

a first and second bracket, each of said first portions of said first and second brackets being removably coupled to said back side of said back plate, said first and second brackets being oriented generally parallel to each other such that said first portions of said first and second brackets extend towards each other, said first bracket being generally located adjacent to said top edge of said back plate, said second bracket being located generally adjacent to said bottom edge of said back plate, said first bracket having a length generally equal to a length of said second bracket;

a third and fourth bracket extending between said first and second brackets, each end of said first portions of said third and fourth brackets being removably coupled to an end of said first and second brackets such that said first portions of said third and fourth brackets extend away from each other, said third and fourth brackets being oriented generally parallel to each other, said third and fourth brackets each having a length generally equal to the distance between said first and second brackets;

a fifth and sixth bracket, each of said first ends of said second portions of said fifth and sixth brackets being removably secured to an end of said second portion of said third bracket such that said first portions of said fifth and sixth brackets extend away from a middle portion of said back plate, each of a pair of rollers each being rotatably coupled to said second end of said second portion of said fifth and sixth brackets, each of said rollers being directed toward said middle portion of said back plate and having a rotational axis oriented generally parallel to said back plate said fifth and sixth brackets being oriented generally perpendicular to a plane of said back plate;

a seventh and eighth bracket, each of said first ends of said second portions of said seventh and eighth brackets being removably secured to an end of said second portion of said fourth bracket such that said first portions of said seventh and eighth brackets extend away from a middle portion of said back plate, each of a pair of rollers each being rotatably coupled to said second end of said second portion of said seventh and eighth brackets, each of said rollers being directed toward said middle portion of said back plate and having a rotational axis oriented generally parallel to said back plate, said seventh and eighth brackets being oriented generally perpendicular to a plane of said back plate; and a ninth and tenth bracket, each of said ninth and tenth brackets having a first portion removably secured to said second portion of said second bracket such that said ninth and tenth brackets extend away from said back side of said plate, each of a pair of rollers each being rotatably coupled to said second portions of said ninth and tenth brackets, one of said rollers being between said ninth bracket and said third bracket and one of said rollers being between said tenth bracket and said fourth bracket, each of said rollers having a rotational axis oriented generally parallel to said back plate, said ninth and tenth brackets being located generally between said third and fourth brackets; and a pulley system for pulling said back plate up said ladder.

10. A ladder hoist device for moving materials up and down an extension ladder having at least a first and a second portion, said device comprising:

a back plate having a front side and a back side, said back plate having a top edge and a bottom edge;

a support plate having an edge fixedly coupled to said front side of said back plate:

a mounting frame comprising:

a plurality of rollers for guiding the back plate alone the rails of the ladder;

a plurality of brackets for rotatably coupling said rollers to said back plate, each of said brackets being coupled to each other and to said back plate, wherein said rollers engage said ladder; and each of said brackets having a first end and a second end, each of said brackets having a first portion and a second portion;

said plurality of brackets further comprising:

a first and second bracket, each of said first portions of said first and second brackets being removably coupled to said back side of said back plate, said first and second brackets being oriented generally parallel to each other such that said first portions of said first and second brackets extend towards each other said first bracket being generally located adjacent to said top edge of said back plate said second bracket being located generally adjacent to said bottom edge of said back plate, said first bracket having a length generally equal to a length of said second bracket;

a third and fourth bracket extending between said first and second brackets, each end of said first portions of said third and fourth brackets being removably coupled to an end of said first and second brackets such that said first portions of said third and fourth brackets extend away from each other, said third and fourth brackets being oriented generally parallel to each other, said third and fourth brackets each having a length generally equal to the distance between said first and second brackets;

a fifth and sixth bracket, each of said first ends of said second portions of said fifth and sixth brackets being removably secured to an end of said second portion of said third bracket such that said first portions of said fifth and sixth brackets extend away from a middle portion of said back plate, each of a pair of rollers each being rotatably coupled to said second end of said second portion of said fifth and sixth brackets, each of said rollers being directed toward said middle portion of said back plate and having a rotational axis oriented generally parallel to said back plate, said fifth and sixth brackets being oriented generally perpendicular to a plane of said back plate;

a seventh and eighth bracket, each of said first ends of said second portions of said seventh and eighth brackets being removably secured to an end of said second portion of said fourth bracket such that said first portions of said seventh and eighth brackets extend away from a middle portion of said back plate, each of a pair of rollers each being rotatably coupled to said second end of said second portion of said seventh and eighth brackets, each of said rollers being directed toward said middle portion of said back plate and having a rotational axis oriented generally parallel to said back plate, said seventh and eighth brackets being oriented generally perpendicular to a plane of said back plate; and a ninth and tenth bracket, each of said ninth and tenth brackets having a first portion removably secured to said second portion of said second bracket such that said ninth and tenth brackets extend away from said back side of said plate, each of a pair of rollers each being rotatably coupled to said second portions of said ninth and tenth brackets, one of said rollers being between said ninth bracket and said third bracket and one of said rollers being between said tenth bracket and said fourth bracket, each of said rollers having a rotational axis oriented generally parallel to said back plate, said ninth and tenth brackets being located generally between said third and fourth brackets;

a pulley system for pulling said back plate up said ladder; and guides for smoothing the transition from the first portion of the ladder to the second portion of the ladder, said guides being removably placed over a juncture of the first and second portions of the ladder.

* * * * *